US008550948B2

(12) United States Patent
Pescheck et al.

(10) Patent No.: US 8,550,948 B2
(45) Date of Patent: Oct. 8, 2013

(54) CONTROLLER FOR A SHIP'S PROPULSION

(75) Inventors: Jürgen Pescheck, Immenstaad (DE); Horst Schulz, Friedrichshafen (DE); Tino Kirschner, Friedrichshafen (DE); Andrea Pellegnnetti, Trento (IT); Nicole Zanoni, Riva del Garda (IT); Alfred Klenzle, Frickingen (DE); Michele Zottele, Trento (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 244 days.

(21) Appl. No.: 13/121,035

(22) PCT Filed: Sep. 29, 2009

(86) PCT No.: PCT/EP2009/062612

§ 371 (c)(1),
(2), (4) Date: Apr. 5, 2011

(87) PCT Pub. No.: WO2010/037743

PCT Pub. Date: Apr. 8, 2010

(65) Prior Publication Data

US 2011/0177904 A1 Jul. 21, 2011

(30) Foreign Application Priority Data

Oct. 2, 2008 (DE) ..... 10 2008 042 599

(51) Int. Cl.
*F16H 48/06* (2006.01)

(52) U.S. Cl.
USPC ..... 475/149; 475/150

(58) Field of Classification Search
USPC ..... 475/149, 150, 207, 219, 343, 330
See application file for complete search history.

(56) References Cited

U.S. PATENT DOCUMENTS 3,021,725 A * 2/1962 Schneider ..... 74/665 S
3,094,967 A 6/1963 Willis, Jr.

(Continued)

FOREIGN PATENT DOCUMENTS

DE 875 771 7/1949
DE 1 012 843 7/1957

(Continued)

OTHER PUBLICATIONS

Von Bernd Klein, "Das Wolfromgetriebe—eine Planetengetriebebauform fur hoh Ubersetzungen", Feinwerktechnik & Messtechnik 89 (1981), pp. 177-184.

(Continued)

*Primary Examiner* — David D Le
*Assistant Examiner* — Steven B Christ
(74) *Attorney, Agent, or Firm* — Davis & Bujold, PLLC; Michael J. Bujold

(57) ABSTRACT

A ship propulsion (3) with at least a fixedly positioned transmission unit (4, 204) secured to the hull (6) of the ship and a propulsion unit (5, 205) located on the exterior of the hull. The ship propulsion (3) facilitates pivoting of the propulsion unit (5, 205) around a control axis (10, 110, 210, 310), via a control device (200, 300). The control device has a control motor (120, 220, 320) and at least one control transmission (130, 230, 330). The control transmission is designed as a reduced planetary transmission, which comprises two central gears (131, 132, 231, 232, 331, 332) and a planetary gear carrier (233, 333, 433) with at least two planetary gears (238, 338), and coaxial positioned with reference to the control axis.

12 Claims, 7 Drawing Sheets

(56) References Cited

U.S. PATENT DOCUMENTS

| | | | | |
|---|---|---|---|---|
| 3,392,603 | A | 7/1968 | Sanders | |
| 3,463,115 | A * | 8/1969 | French | 440/3 |
| 5,024,639 | A * | 6/1991 | Crispo | 475/221 |
| 5,125,858 | A | 6/1992 | Salvetti | |
| 7,090,611 | B2 * | 8/2006 | Kasahara | 475/331 |
| 7,186,157 | B2 | 3/2007 | Mansson et al. | |

FOREIGN PATENT DOCUMENTS

| | | | |
|---|---|---|---|
| DE | 198 45 182 | A1 | 4/2000 |
| DE | 199 02 739 | A1 | 8/2000 |
| DE | 103 14 771 | A1 | 10/2004 |
| DE | 10 2004 058 259 | A1 | 6/2006 |
| DE | 10 2007 005 148 | A1 | 8/2008 |
| GB | 983 462 | | 2/1965 |
| WO | 2005/005249 | A1 | 1/2005 |

OTHER PUBLICATIONS

Johannes Looman, "Zahnradgetriebe", Grundlagen, Konstruktionen, Anwendungen in Fahrzeugen, Springer.

Albert S. Beam, "Beveloid Gearing", Machine Design, Dec. 1954, pp. 220-221.

* cited by examiner

CONTROLLER FOR A SHIP'S PROPULSION

This application is a National Stage completion of PCT/EP2009/062612 filed Sep. 29, 2009, which claims priority from German patent application serial no. 10 2008 042 599.0 filed Oct. 2, 2008.

FIELD OF THE INVENTION

The invention relates to a ship propulsion with a control device to change the direction of action of the propeller thrust.

BACKGROUND OF THE INVENTION

Known ship propulsions have in an embodiment at least one propulsion and control unit, also indicated as rudder propellers, which is positioned underwater, and which is equipped with one or two propellers and which can be pivoted around a vertical control axis. Through the pivoting of the propulsion vector which is generated by the propeller, a steering function is achieved for the boat. The pivoting happens by means of a steering shaft which is driven by a control device.

It is known to pivot hydraulically the rudder propeller by means of a hydraulic motor. Disadvantages of a hydraulic control device are, on one hand, the large weight, the construction effort and the cost of the hydraulic components. A hydraulic pump is needed to drive the hydraulic motor which is, for itself again, driven by an electric motor or a combustion engine, which presents a disadvantage in regard to the efficiency of the entire system.

An electro motor drive of a rudder propeller is known from WO2005005249A1. Hereby, an electro motor, also named as a servomotor, drives, via a transmission which reduces the rotational speed of the electric motor, the pivoted control shaft of the rudder propeller and swivels here the directivity of the thrust of the rudder propeller around a vertical axis. Through a previous use, the design of the transmission of this electric propulsion is known as a two-step planetary transmission which is, after the electro motor, coaxial positioned to it and drives the pivoted control shaft via a following spur wheel stage. A disadvantage hereby is the respective play of the connected in series planetary gears. Also, this kind of control device requires a strong brake device to avoid an unintended torque of a pivoting propulsion unit which is created through external and internal forces. Furthermore, a control transmission which has two planetary transmission sets, positioned one after the other, has a relatively large overall length and also has a relatively large amount of parts.

SUMMARY OF THE INVENTION

The task of the invention is to create a control transmission for a ship propulsion which does not have the disadvantages as in the mentioned state of the art.

A ship propulsion unit comprises at least a transmission unit, fixedly positioned to the ship's hull, and a propulsion unit external to the ship's hull, pivoting around a control axis. Hereby, the propulsion unit is pivoted, by means of a control unit, to set the course of the ship. The control unit comprises of a control motor, which creates the needed mechanical force for pivoting, and a control transmission, which reduces the relatively large rotational speed of the control motor to a required, low angular velocity which is needed for an exact adjustment of the propulsion unit. Also, by means of the control transmission, the torque of the control motor is increased to the required torque which is needed for the pivoting of the propulsion unit. In this invention, the control transmission is designed as a reduced planetary gear transmission which comprises two central gears and a planetary gear carrier with at least two planetary gears. In addition, the reduced planetary gear transmission is positioned coaxial with the control axis.

The control transmission is preferably designed as a reduced planetary gear transmission, and constructed as a Wolfrom-planetary gear set.

In an especially preferred embodiment, a first central gear of the control transmission is torque-proof (continuously) connected with the transmission unit so as to prevent relative rotation between the first central gear and the transmission unit. The planetary gear carrier, which is driven by the control motor, is hereby active as an input link and a second central gear as the output link, whereby the output link is torque-proof (continuously) connected with the pivoting propulsion unit so as to prevent relative rotation between the output link and the pivoting propulsion unit.

In an enhancement of the inventive matter, the control transmission has a central passage in which at least one vertical shaft is positioned for the transfer of the drive power to the propulsion unit.

The central gears are preferably designed with an outer gearing.

Also, and in accordance with the invention, it can be provided that the planetary gears have a continuous, common gearing which is designed through a first and a second engagement section of the planetary gear, and that the central gears have a different number of teeth.

Finally, as an advantage it is determined that the drive of the active planetary gear carrier, representing the input link, is designed as a spur gear section with a beveloid-gearing.

In an especially preferred embodiment, the spur gear section which drives the active planetary gear carrier, representing the input link, is designed with a beveloid-gearing.

In an additional embodiment, a preliminary transmission stage is positioned between the control motor and the input link of the control transmission for an additional reduction in the rotational speed of the control motor.

It is also possible that for pivoting of the propulsion unit, in the event of a power failure, an emergency actuation device is provided through which the input link of the control transmission can be pivoted.

In an alternative version which has a configuration with two planetary gears at the planetary gear carrier, an elastic pre-tensioning device is provided for the reduction of a gear backlash between the planetary gears and the central gears.

In an additional embodiment of the invention, the ability to pivot the propulsion unit with reference to the firmly mounted transmission unit is limited to a maximum pivoting angle and a damping device is positioned as a pivoting angle limiter between the transmission unit and the control unit.

BRIEF DESCRIPTION OF THE DRAWINGS

Hereafter, the present invention is further explained through the drawings. It shows.

DETAILED DESCRIPTION OF THE PREFERRED EMBODIMENTS

Figure 1:
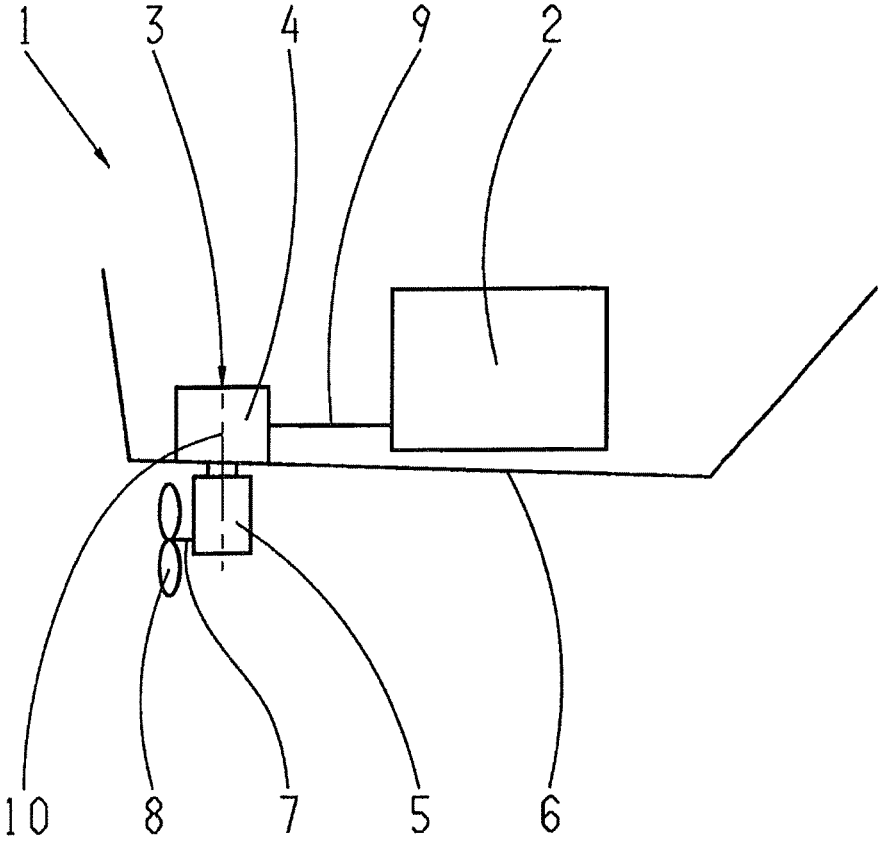
FIG. 1 a schematic presentation of a propulsion configuration for the propulsion and steering control of a ship.

FIG. 1 shows a schematic presentation of a propulsion configuration for the propulsion and control of a ship 1, whereby the ship can also have several of the described propulsion configurations. The propulsion configuration comprises an engine 2 and a ship propulsion 3, which is designed as a rudder propeller. The ship propulsion 3 hereby comprises a transmission unit 4 and a propulsion unit 5, coupled with it, whereby the transmission unit 4 is positioned and firmly mounted inside of the hull 6 and the propulsion unit 5 is positioned outside of the hull 6 in the water, pivotable around a vertical control axis 10. At least one rotatable propeller shaft 7, with a torque-proof attached propeller 8, is attached to the propulsion unit 5. The torque flow from the engine 2 to the propeller shaft 7 occurs in a Z-shape through the transmission unit 4 and the propulsion unit 5 by means of a drive train which also comprises of an engine shaft 9 and the propeller shaft 7 which are coupled, not shown here, through horizontal and vertical rotatable positioned shafts. The steering motion of the ship 1 occurs through a pivoting of the propulsion unit 5 which hereby causes a change in the direction of the thrust of the propeller 8. Thus, the propulsion unit 5 fulfills the function of the propulsion and the steering, or the creation as well as the directivity of a thrust, respectively. As described in FIG. 2, the pivoting of the propulsion unit 5, with respect to the transmission unit 4, occurs by means of a control unit on the vertical control axis 10 which is, at the same time, the rotational axis of at least one vertical shaft. In addition, one or several spur wheel stages can be positioned in the transmission unit 4 to convert the rotational speed of the engine 2 into the desired propeller rotational speed.

Figure 2:
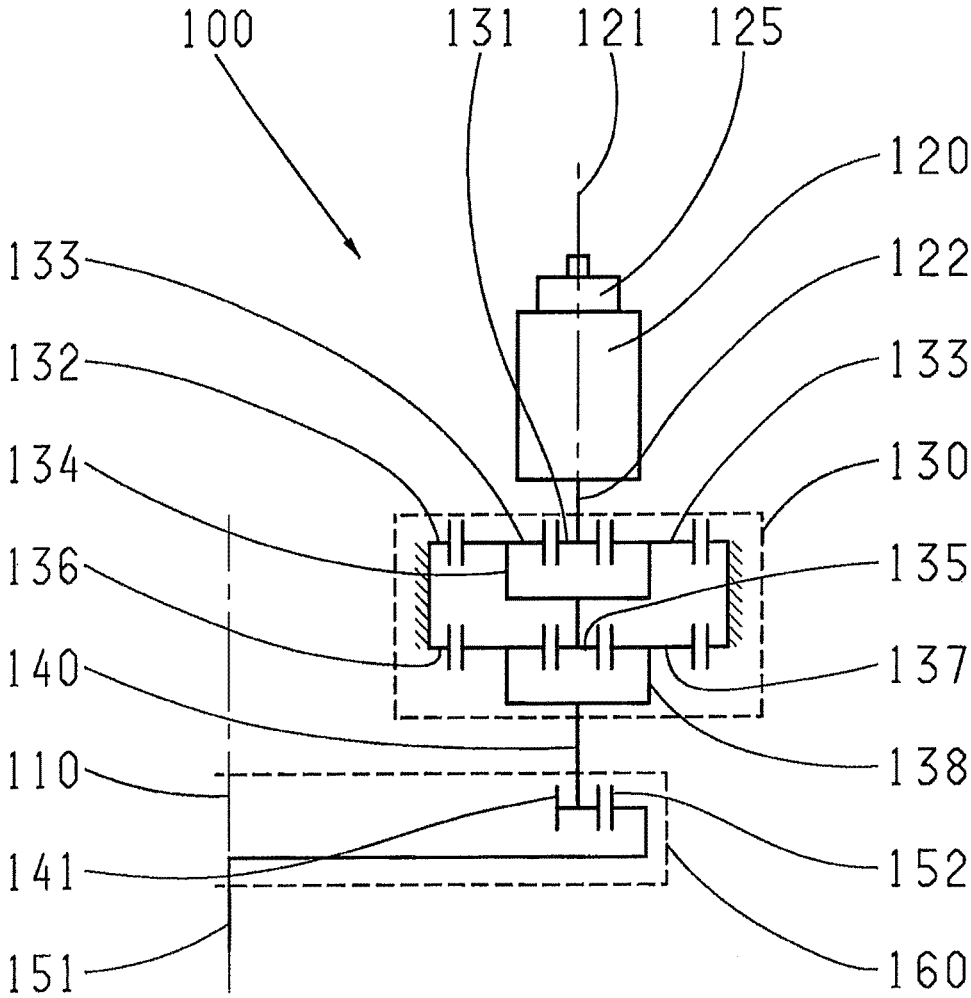
PRIOR ART Fig. 2
FIG. 2 a schematic presentation of a control unit as in this state of the art.

FIG. 2 schematically presents a control unit 100 in accordance with the state of the art. The control unit 100 comprises an electric control motor 120 and a control transmission 130, whereby the control transmission 130 is concentrically positioned along a motor axis 121 of the control motor 120. An output shaft 140 of the control transmission 130 is coupled via a spur wheel stage 160 with the control shaft 151 which can be pivoted around the control axis 110. The control shaft 151 is torque-proof connected with the propulsion unit 5 (not shown here).

The control transmission 130 comprises of two concentric planetary gear sets, positioned one after the other meaning that the output link of one of the first planetary gear sets is torque-proof connected with the input link of the second planetary gear set. The planetary gear set comprises a sun gear, positioned on a center axis, at least two planetary gear wheels which are rotatably supported on a planetary gear carrier and which mesh with the sun gear, as well as a ring gear which is also positioned centrically with the transmission axis, and its inner gearing also meshes with the planetary gears.

In the control unit 100, in accordance with the state of the art, a sun gear 131 of the first planetary gear set, as the input link of the control transmission 130, is torque-proof connected with the control motor shaft 122 so that the control motor 120 and the control transmission 130 are along the same center axis 121. The center axis 121 extends parallel to the control axis 110. A ring gear 132 is fixed. The sun gear 131, which is driven by the control motor 120, drives the planetary gear wheels 133, which support themselves on the ring gear 132 and hereby drive the planetary gear carrier 134. The output of the first planetary gear set occurs through the planetary gear carrier 134, as the output link. In such selected configuration of the elements of a planetary transmission, the angle velocity of the output link is lower than the that of the input link. The planetary gear carrier 134 and a sun gear 135, of the second planetary transmission, are torque-proof connected with one another. A ring gear 136 of the second planetary gear set is also fixed so that the sun gear 135 drives a planetary gear carrier 138, via several planetary gear wheels 137, whereby the angle velocity, or rotational speed, respectively, is again reduced. The planetary gear carrier 138, as the output link of the control transmission 130, is torque-proof connected with the transmission output shaft 140 which, in a spur wheel stage 160 and by means of an outer gearing 141, meshes with an inner gearing 152. The inner gearing 152 is positioned coaxial with the control axis 110 and is torque-proof connected with the control axis 151.

To steer control the ship, the control motor 120 will be switched on whereby, via the transmission output shaft 140 and the inner gearing 152, the control shaft 151 and thus the propulsion unit 5 are pivoted around the vertical axis 110. The control transmission 130 reduces the rotational speed of the control motor 120 to achieve the required low angle velocity, at the propulsion unit 5, for exact adjustment. In the shown configuration of two planetary transmission sets in series, the total gear ratio of the control transmission 130 corresponds to the product of the singular gear ratios of the planetary transmission sets. An additional reduction of the rotational speed is achieved through the gear ratio of the spur wheel stage 160, between the designed outer gearing 141, at the transmission output shaft 140, and the inner gearing 152.

If the control motor 120 is turned off and the ship is on course, external disturbing forces from the water or internal forces, for instance a radial force component from the propeller thrust, can affect the propulsion unit 5. Under the influence of these forces, the control transmission 130 and thus the control motor 120 can be driven, via the transmission output shaft 140, so that the propulsion unit 5 turns, in an unwanted manner, and the course of the ship changes. For controlling spin of the control unit 100, an additional, actuated brake device 125 is required in the control unit which, in case of a turned off control motor 120, generates a resistance to an interfering torque for the propulsion unit 5 and thereby avoids a movement of the propulsion unit 5.

Figure 3:
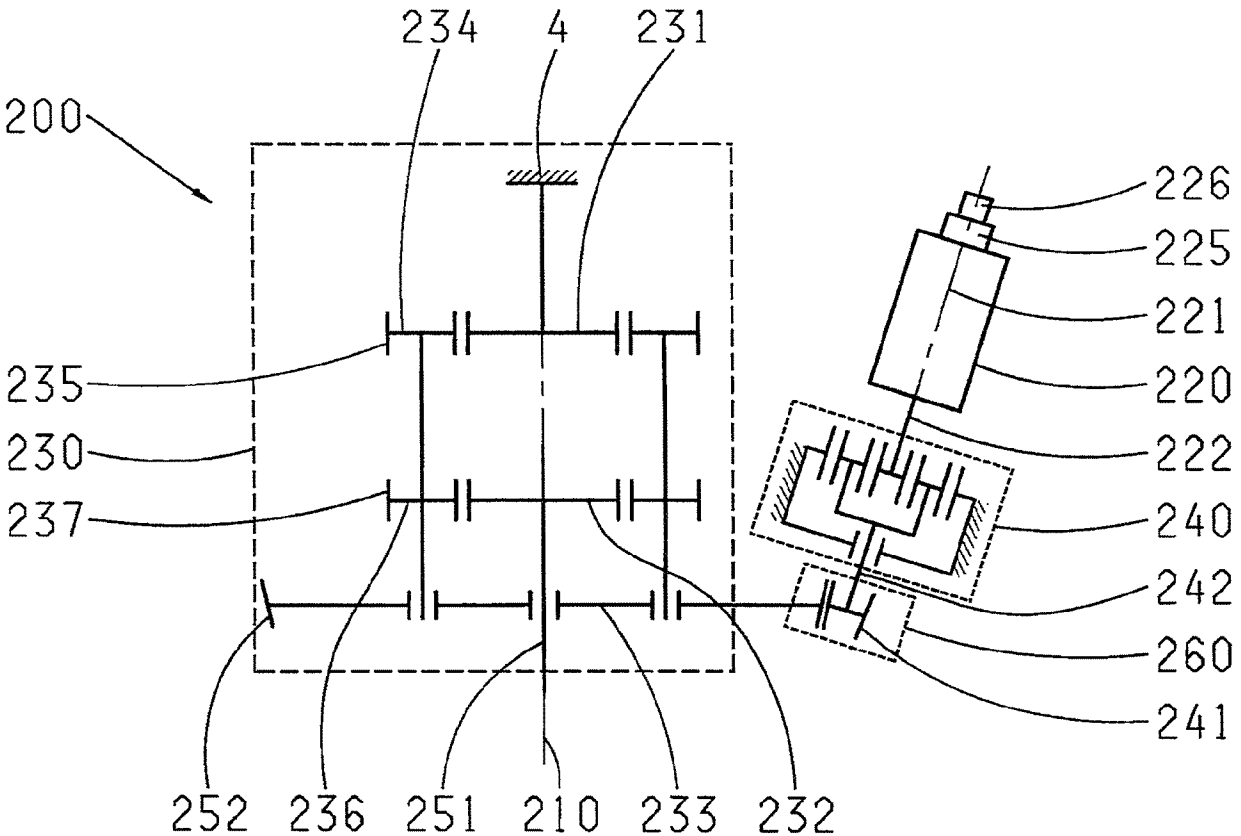
FIG. 3 a schematic presentation of an invented control unit.
Figure 4:
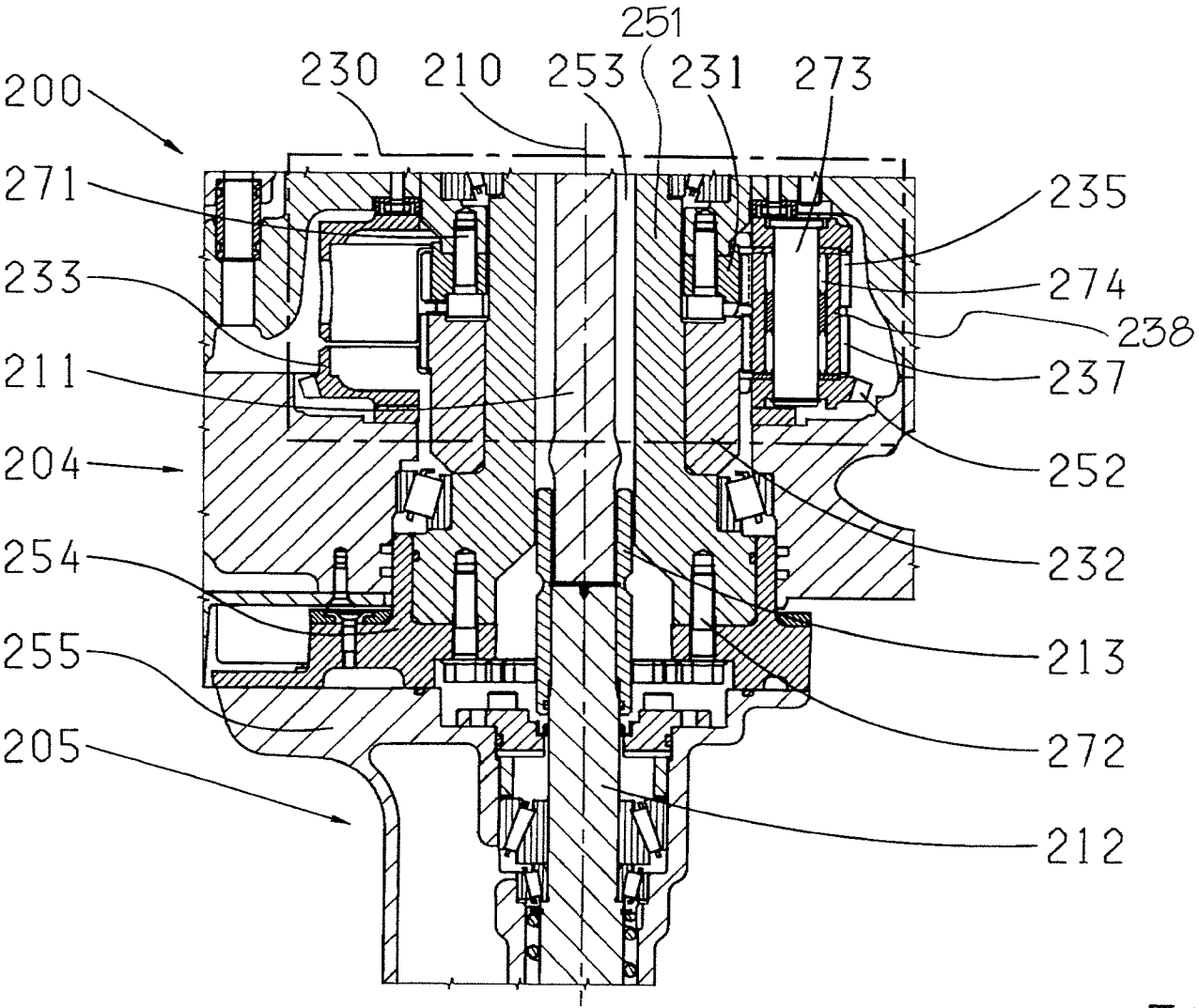
FIG. 4 a sectioning presentation of an invented control unit.

The invented control device 200 is presented as a schematic in FIG. 3. It comprises an electric control motor 220, a control transmission 230 and an optional single stage planetary transmission 240, acting as a pre-stage, which is concentric positioned along a center axis 221 of the control motor 220. The control transmission 230 is hereby concentrically positioned around the control axis 210 and has a central passage, as shown in FIG. 4, to accommodate a vertical shaft which transfers a drive torque to the propeller shaft.

The control transmission 230 is designed, in accordance with the invention, as a reduced planetary transmission. In the expert language, a reduced planetary gear transmission is meant to be a planetary gear transmission which comprises two central gears and a planetary gear carrier with at least two planetary gear sets, whereby the planetary gears of a first planetary gear set mesh with the first central gear and the planetary gears of the second planetary gear set mesh with the second central gear. The planetary gears of both planetary gear sets are hereby torque-proof connected to a so-called step planetary gear. Embodiments of a reduced planetary gear transmission are, for example, a Wolfrom-planetary gear transmission set or a so-called "Hi-Red" transmission. Such designed transmissions are applied as a so-called actuating gearing and allow the transformation from a high gear ratio to a low one. Here, the described control transmission 230 is designed as a Wolfrom-transmission set. It comprises two central gears which are either designed as sun gears or as ring gears. The design of a first central gear, as a sun gear, and of a second central gear, as a ring gear, is also possible. In addition, the Wolfrom-transmission comprises a planetary gear carrier to which two planetary gear sets are supported whereby, as described above, the planetary gears of a first planetary gear set mesh with the a first central gear and the planetary gears of a second planetary gear set mesh with the second central gear. The planetary gears of the two planetary gear sets rotate around the same shaft and are torque-proof connected with one another to achieve a gear ratio and thus a change in rotation, the central gears and/or the planetary gears, which each are connected to a step planetary gear, need to provide a difference in the number of teeth. If either only the planetary gears or just only the central gears have the same number of teeth, then the difference in the number of teeth, in the different gearings, needs to be equal to the number of planetary gears for each planetary gear set. To achieve functioning mesh conditions, the different gearings have different modifications in their profile. The smaller the difference is in the number of teeth, the larger the gear ratio gets.

Such a designed control transmission 230 has a fixed sun gear 231, as its first central gear, which is fixedly connected with the transmission unit 204 of the ship propulsion. The second central gear is designed as a sun gear 232 which is rotatably positioned around the control axis 210 and which is torque-proof connected with a control shaft 251 and thus with the control unit 205, not shown here. Therefore, the sun gear 232 forms the output link of the control transmission 230. The input link of the control transmission 230 is about by a planetary gear carrier 233, in which carries two planetary gear sets. A first planetary gear set comprises at least two planetary gears 234 and a second planetary gear set comprises at least two planetary gears 236. The planetary gears 234 and 236 are torque-proof linked with one another as a pair and rotate around the same shaft and also mesh, as described above, with the sun gears 231 and 232.

To achieve a gear ratio effect, either at least the sun gears 231 and 232 or the planetary gears of the planetary sets 234 and 236 must have a difference in the number of teeth. It is an advantage, in view of manufacturing and installation space, to design the planetary gears of both planetary gear sets in the advantageous and same manner with regard to the geometry of the gearing, and to design it, as described in FIG. 4, as a continuously geared step planetary gear which meshes, in a first engagement section 235, with the central gear 231 and, in a second engagement section 237, with the central gear 232. The engagement widths of the two engagement sections do not necessarily need to be the same, but can be matched to the respective load conditions.

The planetary gear carrier 233, which acts as the input link of the control transmission 230, is driven by means of a spur gear section 260 via an output shaft 242 of the planetary transmission 240, but can also be set in motion by a control motor shaft 222, in case the planetary transmission set 240 has been eliminated. In the described example, the output shaft 242 of the planetary transmission set 240 has an outer geared beveloid gear 241 which meshes with the outer gearing 252 at the planetary gear carrier 233 and which it drives. The beveloid gearing allows tilting of the center axis 221 of the control motor 220, which results in a more favorable installation space of the electric motor 220 and the transmission unit 4. It is theoretically possible to use a regular spur gear, however, in that case the control axis 210 and the center axis 221 need to extend parallel. After the gear ratio of the spur gear section 260 has occurred, the rotational speed is thereafter further reduced in the control transmission 230. The driven planetary gear carrier 233 allows the planetary gears 234, of the first planetary gear set, to support themselves via the sun gear 231 and the planetary gears 236, of the second planetary gear set, to roll on the sun gear 232. The number of teeth and the gearing geometry of the two planetary gear sets are the same, in this embodiment example. If neither sun gears 231 and 232 nor the planetary gears 234 and 236 would have a different number of teeth, the planetary gears 236 would roll around on the sun gear 232 and the sun gear 232 would stand still. Due to the difference in the number of teeth of the sun gears 231 and 232 and/or the difference in the number of teeth of the planetary gears 234 and 236, however, the sun gear 232 turns during a rotation of the planetary gear carrier 233 by the amount of teeth which corresponds to the difference in the number of teeth. A difference in a number of teeth, between both of the sun gears 231 and 232 or the planetary gears 234 and 236, is only possible if they show different profile shifts to create the proper meshing ratios.

An additional specialty of the Wolfrom-transmission is the dependence of the losses of throughput, or the transmission efficiency, respectively, with regard to the throughput direction. If the Wolfrom-gear set is driven via the planetary gear carrier 233, as described, the losses of throughput are significantly lower and, therefore, the transmission efficiency is significantly higher in a drive of the Wolfrom-transmission via the control shaft 251. That characteristic is desired for this application. If interfering torques occur at the steering control 5, the larger throughput losses, at the driven side, increase the resistance against the unwanted torsion of the steering control 5. A brake device 225, positioned at the control motor 220, can therefore be designed for a significantly lower brake torque as compared with the state of the art, described in FIG. 2. In case of a power failure, steering of the ship still needs to be possible. For this purpose, an emergency actuator device 226 is provided, at the control motor 220, which is torque-proof connected with the control motor shaft 222. By means of the emergency actuator device 226, the control motor shaft 222 can be manually rotated and, therefore, the propulsion unit 5 can be pivoted.

FIG. 4 shows a cross sectional view of the steering control device 200. The sun gear 231 is firmly connected with the transmission unit 204 via fastener parts 271 which, in this example, are designed as cylinder screws. The sun gear 232 is torque-proof positioned, by means of a shrink fit, to the control shaft 251. The control shaft 251 is pivoted in the transmission unit and designed as a hollow shaft so that it has a central passage 253. A vertical drive shaft 211 is rotatable positioned, in this central passage 253, around the control axis 210. The vertical drive shaft 211, which is positioned in the transmission unit 204, is torque-proof connected with a vertical drive shaft 212, by means of the coupling device 213, which leads, via a drive unit 205, to the propeller shaft. At the planetary gear carrier 233, which can be driven via the beveloid outer gearing 252, three step planetary gears 238 are rotatable positioned. The step planetary gears 238 have been designed as one part through a compact, torque-proof connection of the planetary gears 234 and 236 and are rotatable positioned, by means of a roller bearing 274, around a bearing bolt 273. The step planetary gear 238 has two engagement sections to 235 and 237 and meshes, in the engagement section 235, with the sun gear 231 and meshes, in the engagement section 237, with the sun gear 232. It is an advantage, during the manufacturing, to design the engagement sections 235 and 237 equal with regard to the gearing geometry. The widths of the two sections do not need to be necessarily equal and can be matched to the respective load conditions.

At a lower end of the control shaft 251, a control flange 254 is torque-proof connected with the control shaft 251, toward the top, and connected with the control housing 255 of the pivotable drive unit 205, toward the bottom, Thus, the control flange 254 transmits the pivoting motion of the control shaft 251 to turn the drive unit 205 around the control axis 210 when a change in course is desired.

Figure 5:
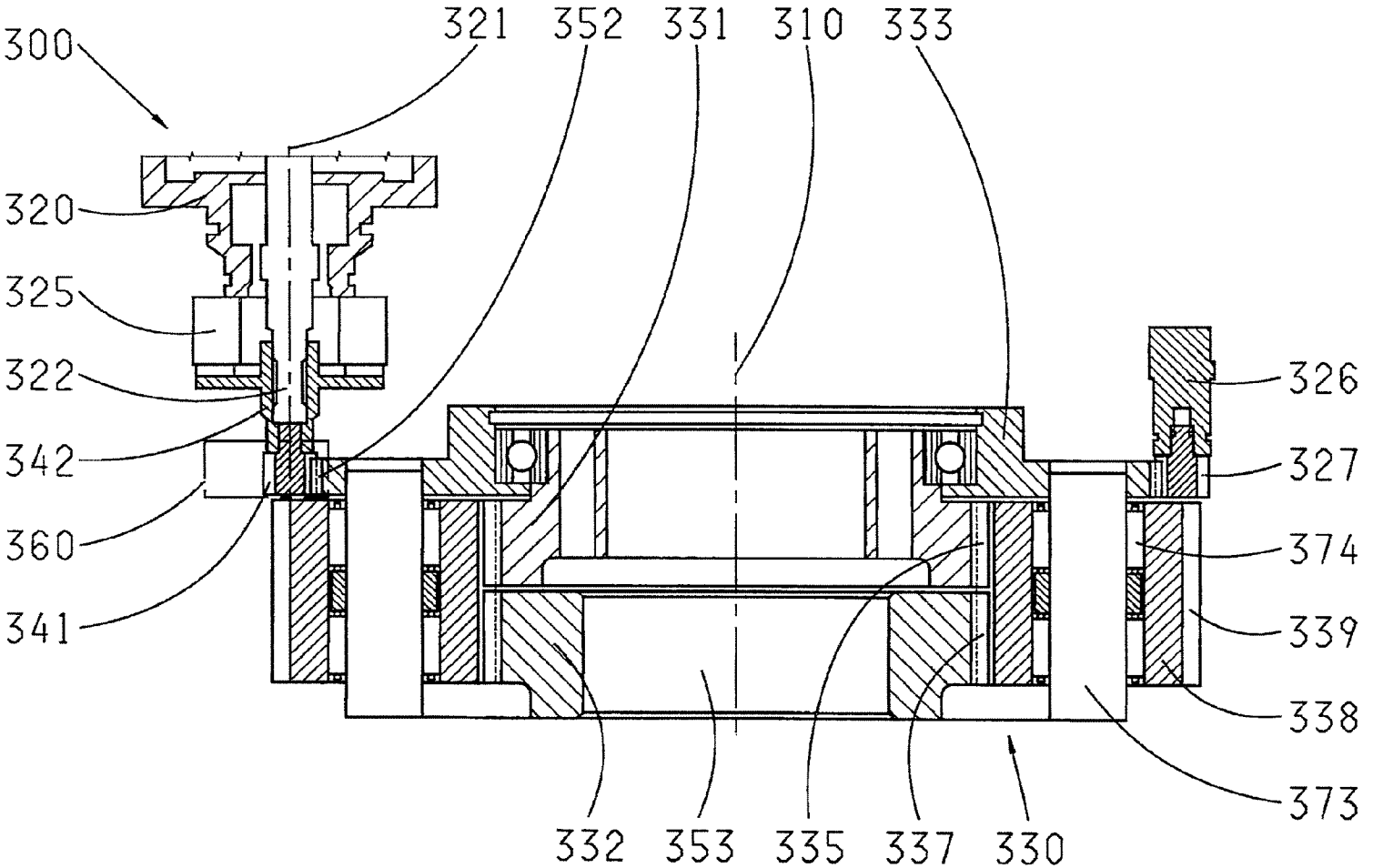
FIG. 5 a perspective presentation of the control unit, extracted from the ship's propulsion.

FIG. 5 presents a cross section for an alternatively designed control device 300 with a control transmission in a Wolfrom configuration. A control motor 320 is with its center axis 321 positioned parallel to a control axis 310 and has a control motor shaft 322 which is torque-proof connected with the output shaft 342. A header gearing 341 is provided, on the output shaft, which meshes with an outer gearing 352 of a planetary gear carrier 333, so that the header gearing 341 and the outer gearing 352 form a spur gear section 360. A header gearing 327 of an emergency actuator 326 also meshes with the outer gearing 352 of the planetary gear carrier 333 and is positioned, in the presentation, opposite to the spur gear section 360. The planetary gear carrier 333 is rotatably positioned around a sun gear 331, which is torque-proof connected with a transmission unit (not shown here) and carries at least two step planetary gears 338 which are each rotatably positioned, by means of a bearing 374, around a bearing bolt 373. All step gears 338 together form a planetary gear set. Each step planetary gear 338 is designed with a continuous gearing which meshes, in an engagement section 335, with the outer gearing of the sun gear 331 and meshes, in an engagement section 337, with the outer gearing of a sun gear 332. The sun gear 332, as an output link of the control transmission 330, is torque-proof connected with a non-shown control shaft of a propulsion unit. A central passage 353, in the sun gears 331 and 332, creates the installation space for the configuration of a non-shown vertical shaft which transports the power output of the non-shown engine 2 to the propeller shaft 7. The function of the control transmission 330 is principally the same as the control transmission 230 described in FIG. 3. Since the step gears 338 have a continuous gearing 339 in both engagement sections 335 and 337, they can easily be manufactured and installed. To obtain a gear ratio, the sun gears 331 and 332 need to have a different number of teeth which is equal to the number of the step gears 338.

To be able the change the course of a ship, even during a power failure, an emergency actuator 326 is provided which can be turned and, therefore, can be used to drive the planetary gear carrier 333 for steering of the ship. A brake device 325 prevents a shifting of the propulsion unit by interfering torques. If a ship has the control device 300, the brake device 325, due to the application of a Wolfrom transmission as the control transmission 330 or its specialty regarding the different efficiencies at the reversal of the propulsion, respectively, can be designed less powerful and therefore smaller then in the state of the art.

Figure 6:
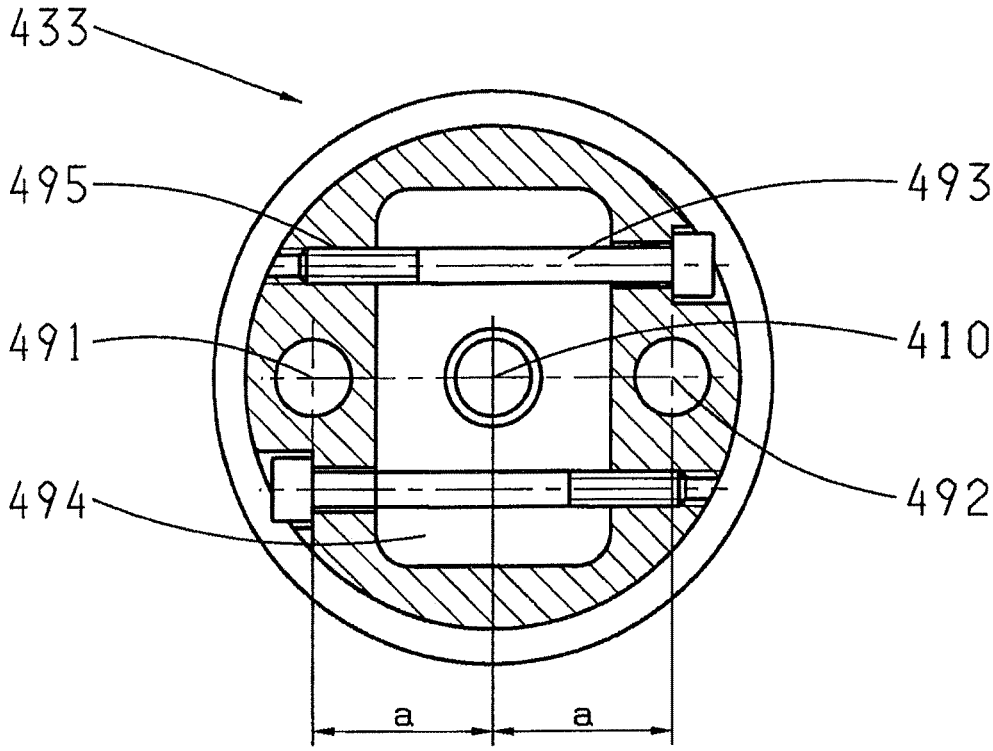
FIG. 6 a schematic presentation of an advantageous embodiment of a planetary gear carrier, and FIG. 7 a perspective presentation of the control unit with a steering control angle limiter.

FIG. 6 shows a schematic presentation of a cross section of an advantageous embodiment of a planetary gear carrier 433. The lack of play of the transmission parts is very important for the application as a control transmission with a requirement for steering precision. A planetary carrier 433, at which two non-shown planetary gears are, opposite at 180°, rotatable positioned around an axial center point 491 and an axial center point 492. The distance of the axial center point 491 or 492 to a control axis 410, which represents the center of the planetary gear carrier 433, is determined as the axial distance a. The planetary gear carrier 433 can possess, as an advantageous embodiment, an elastically limited and changeable axial distance a when several tensions screws 493, positioned in the direction of the axial distance a, are provided. The tension screws 493 are each hereby screwed into a thread 495 which is provided in the planetary gear carrier 433. The structure of the planetary gear carrier 433, due to the recess 494, is designed as flexible in reference to the direction of effect. By means of the tension screws 493 and due to a stepless, selectable tension torque, a limited adjustment of the axial distance a of the planetary gears is possible for a play reduction. An additional design is created when the tension grows 493, in an adjustment during the installation, are secured by means of a securing part against loosening. A possible securing part is, for instance, a liquid screw securing on the basis of anaerobic glue in the area of the thread 495.

Figure 7:
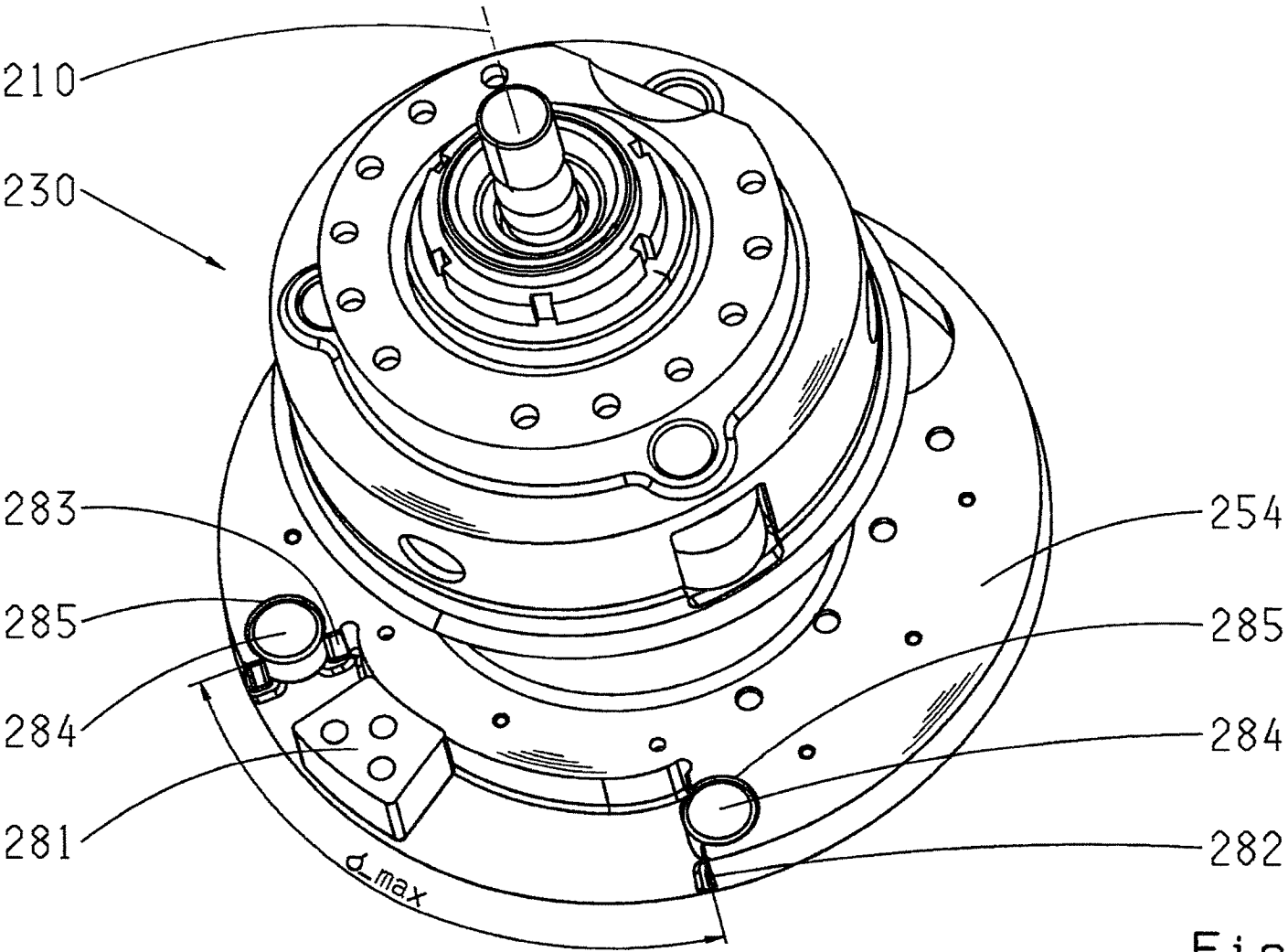

In FIG. 7, a perspective view of an assembly which has been extracted from the control unit 200, and the assembly comprises of the control transmission 230 and the control flange. Theoretically, the control flange 254, and thus the non-shown drive unit 205 which is designed as a rudder propeller of a ship propulsion 203, can be swiveled over a swivel angle of more than 360° around the control axis 210. However, a maximum swivel angle σ_max can become limited because of construction specialties of the ship propulsion 3 or the hull 6. For instance, a design as a so called tunnel indentation in the outer contour of the hull 6 can limit the swivel angle. The swivel angle can be measured by means of a provided sensor device and can be recorded or displayed, respectively, in the ship control unit, however, due to safety reasons, a mechanical limitation is required in any case. Hereby, at least one stopper element 281 is provided which is fixedly positioned at the non-shown transmission unit 204. Known from the state of the art are only rigid stoppers which cause the disadvantages, for instance, an impact noise or unwanted load peaks of the parts. In the pivotable control flange 254, the control unit 200 has at two steps 282 and 283, limiting the swivel angle σ_max, in each case at least one elastic element as a stopping damper 284, which can be designed for instance as rubber buffers. The fastening of the stopping damper 284 is accomplished through a damper receptacle 285 which is designed as a blind via. The stopping damper 284, which is inserted into the blind via, has a cylindrical design. The design of the damper receptacle 285 has an advantage of easy manufacturability. Furthermore, the elastic element is, on one hand, in an advantageous way fixedly positioned but, on the other hand, it can easily be replaced because elastic elements are exposed to wear. The stopping dampers 284 can also be attached to the stopper element 281. The stopper element 281 by itself can also be designed, to meet the functionality, to reside at the pivotable control unit 205 and the steps 282 and 283 of the fixed mounted transmission unit 204.

REFERENCE CHARACTERS

1 Ship
2 Engine
3 Ship Propulsion
4 Transmission Unit
5 Propulsion Unit
6 Hull
7 Propeller Shaft
8 Propeller
9 Engine Shaft
10 Control Axis
100 Control Unit
110 Control Axis

120 Control Motor
121 Center Axis
122 Control Motor Shaft
125 Brake Device
130 Control Transmission
131 Sun gear (they call it Center Gear)
132 Ring Gear
133 Planetary Gear
134 Planetary Gear Carrier
135 Sun Gear
136 Ring gear
137 Planetary Gear
138 Planetary Gear Carrier
140 Transmission Output Shaft
141 External Gearing
151 Control Shaft
152 Internal Gearing
160 Spur-Wheel Stage
200 Control Device
203 Ship Propulsion
204 Transmission Unit
205 Drive Unit
210 Control Axis
211 Vertical Drive Shaft
212 Vertical Drive Shaft
213 Coupling Device
220 Control Motor
221 Center Axis
222 Control Motor Shaft
225 Brake Device
226 Emergency Actuation Device
230 Control Transmission
231 Sun Gear
232 Sun Gear
233 Planetary Gear Carrier
234 Planetary Gear Set
235 Engagement Section
236 Planetary Gear Set
237 Engagement Section
238 Step Planetary Gear
240 Planetary Transmission Section
241 Beveloid Gear
242 Output Shaft
251 Control Shaft
252 Beveloid Outer Gearing
253 Central Passage
254 Control Flange
255 Control Housing
260 Spur Gear Section
271 Fastener Part
272 Fastener Part
273 Bearing Bolt
274 Rolling Bearing
281 Stopper Element
282 Step
283 Step
284 Stopping Damper
285 Damper Receptacle
300 Control Device
310 Control Axis
320 Control Motor
321 Center Axis
322 Control Motor Shaft
325 Brake Device
326 Emergency Actuator Unit
327 Header Gearing
330 Control Transmission
331 Sun Gear
332 Sun Gear
333 Planetary Gear Carrier
335 Engagement Section
337 Engagement Section
338 Step Planetary Gear
339 Gearing
341 Header Gearing
342 Output Shaft
352 Outer Gearing
353 Central Passage
360 Spur Gear Section
373 Bearing Bolt
374 Bearing
410 Control Axis
433 Planetary Gear Carrier
491 Axis Center Point
492 Axis Center Point
493 Tensioning Screw
494 Recess
495 Thread
a Distance
σ_max maximum swivel angle

The invention claimed is:

1. A ship propulsion (3) comprising a transmission unit (4, 204) being fixed in position within a hull (6) of a ship, a control device (200, 300) communicating with a portion of the ship propulsion (3) to pivot the portion of the ship propulsion around a control axis (10, 110, 210, 310);

a propulsion unit (5, 205) being located outside the hull and connected to the transmission unit;

the control device having a control motor (120, 220, 320) and at least one control transmission (130, 230, 330);

the control transmission (230, 330) being a reduced planetary transmission comprising first and second central gears (231, 232, 331, 332) and only one planetary gear carrier (233, 333) comprising at least first and second planetary gears (238, 338); and the planetary gear carrier (233, 333) comprising the first and the second planetary gears (238, 338) being coaxial with the control axis.

2. The ship propulsion according to claim 1, wherein the control transmission (230, 330) is a Wolfrom planetary gear set.

3. The ship propulsion according to claim 1, wherein the first central gear (231, 331) of the control transmission (230, 330) is continuously connected with the transmission unit (204) so as to prevent relative rotation between the first central gear and the transmission unit, the planetary gear carrier (233, 333) is an input link which is driven by the control motor (220, 320), and the second central gear (232, 332) is an output link, the output link is continuously connected with the propulsion unit (5, 205) so as to prevent relative rotation between the output link and the propulsion unit, and the propulsion unit being pivotable.

4. The ship propulsion according to claim 1, wherein the control transmission (230, 330) has a central passage (253, 353) at least one vertical shaft (211, 212) is positioned within the central passage and transmits propulsion power to propel the ship.

5. The ship propulsion according to claim 1, wherein the first and the second central gears (231, 232, 331, 332) each comprise an exterior gearing.

6. The ship propulsion according to claim 1, wherein the first and the second planetary gears (338) each have equivalent gearing (339) comprising a first axial section (335) and a second axial section (337), the first axial section of the gearing engages the first central gear and the second axial section of the gearing engages the second central gear, and the first central gear has a different number of teeth than the second central gear.

7. The ship propulsion according to claim 3, wherein the control motor drives a spur gear (260, 360) which engages and drives the planetary gear carrier (233, 333), which is the input link of the control transmission.

8. The ship propulsion according to claim 7, wherein the spur gear (260), which drives the planetary gear carrier (233) is a bevel gear (241, 252).

9. The ship propulsion according to claim 7, wherein a transmission pre-stage (240) is positioned, between the control motor (220) and the input link of the control transmission, for achieving a reduction in a rotational speed of the control motor.

10. The ship propulsion according to claim 1, wherein an emergency actuator device (226, 326, 327) pivots the input link of the control transmission (230, 330) to pivot the propulsion unit (5, 205), in an event of a power failure of the control motor.

11. A ship propulsion (3) with at least a fixed positioned transmission unit (4, 204) in a hull (6) of a ship and, a portion of the ship propulsion (3) being pivotable around a control axis (10, 110, 210, 310) via a control device (200, 300);

a propulsion unit (5, 205) being located outside the hull;

the control device having a control motor (120, 220, 320) and at least one control transmission (130, 230, 330);

the control transmission (230, 330) being a reduced planetary transmission comprising of two central gears (231, 232, 331, 332) and a planetary gear carrier (233, 333) with at least two planetary gears (238, 338);

the planetary gear carrier (233, 333) with at least two planetary gears (238, 338) being positioned coaxially with reference to the control axis; and an elastic bias-tension device (493) is provided in a configuration of two planetary gears, at the planetary gear carrier (433), for a reduction in tooth play between the planetary gears and the central gears.

12. A ship propulsion (3) with at least a fixed positioned transmission unit (4, 204) in a hull (6) of a ship and, a portion of the ship propulsion (3) being pivotable around a control axis (10, 110, 210, 310) via a control device (200, 300);

a propulsion unit (5, 205) being located outside the hull;

the control device having a control motor (120, 220, 320) and at least one control transmission (130, 230, 330);

the control transmission (230, 330) being a reduced planetary transmission comprising of two central gears (231, 232, 331, 332) and a planetary gear carrier (233, 333) with at least two planetary gears (238, 338);

the planetary gear carrier (233, 333) with at least two planetary gears (238, 338) being positioned coaxially with reference to the control axis; and the pivoting of the propulsion unit (205), in reference to the fixed transmission unit (204), is limited to a maximum swivel angle ($\sigma$_max) and a damping device (284, 285) is positioned, between the transmission unit and the control unit, as a swivel angle limiter (281, 282, 283).

* * * * *